US006263945B1

(12) United States Patent
Nien

(10) Patent No.: US 6,263,945 B1
(45) Date of Patent: Jul. 24, 2001

(54) VENETIAN BLINDS

(76) Inventor: Ming Nien, 11 Kung-Chu Road Hou-Liao Village, Fang-Yuan Township, Changhua County (TW)

( * ) Notice: Subject to any disclaimer, the term of this patent is extended or adjusted under 35 U.S.C. 154(b) by 0 days.

(21) Appl. No.: 09/487,034

(22) Filed: Jan. 19, 2000

(51) Int. Cl.[7] ..... E06B 9/38
(52) U.S. Cl. ..... 160/173 R; 160/178.1 R
(58) Field of Search ..... 160/168.1 R, 173 R, 160/168.1 V, 173 V, 178.1 R, 178.1 V, 405

(56) References Cited

U.S. PATENT DOCUMENTS 2,673,608 * 3/1954 Nelson ..... 160/178.1 R
2,696,879 * 12/1954 Walker ..... 160/168.1 R
2,876,834 * 3/1959 Walker ..... 160/168.1 R
3,425,480 * 2/1969 Anderle et al. ..... 160/178.1 R
4,441,540 * 4/1984 Tsuhako ..... 160/178.1 R
4,518,025 * 5/1985 Judkins ..... 160/168.1 R
4,699,196 * 10/1987 Elliott ..... 160/168.1 R
5,520,235 * 5/1996 Coleman ..... 160/178.1 R

* cited by examiner

*Primary Examiner*—David M. Purol
(74) *Attorney, Agent, or Firm*—Sheldon & Mak

(57) ABSTRACT

The invention is a venetian blind which incorporates an elongate support member as part of the header which allows the width of the blinds to be reduced by cutting without having to cut through the support. The invention also includes venetian blinds that have a header which is better suited to being cut without incurring damage.

24 Claims, 3 Drawing Sheets

FIG. 3
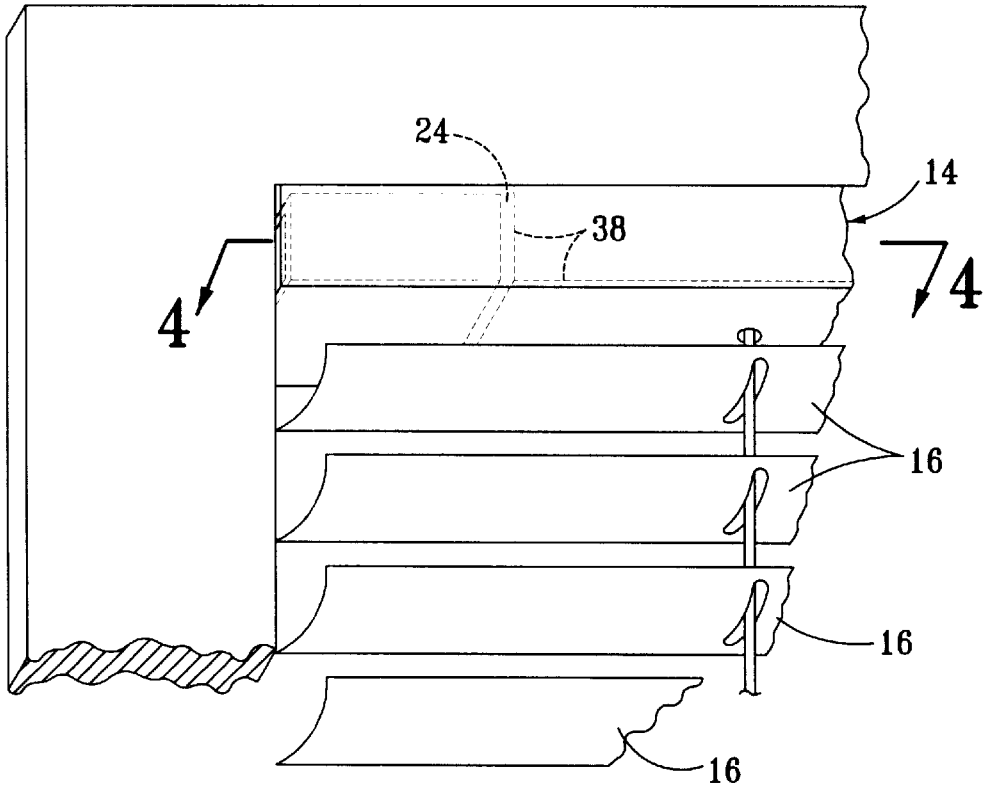
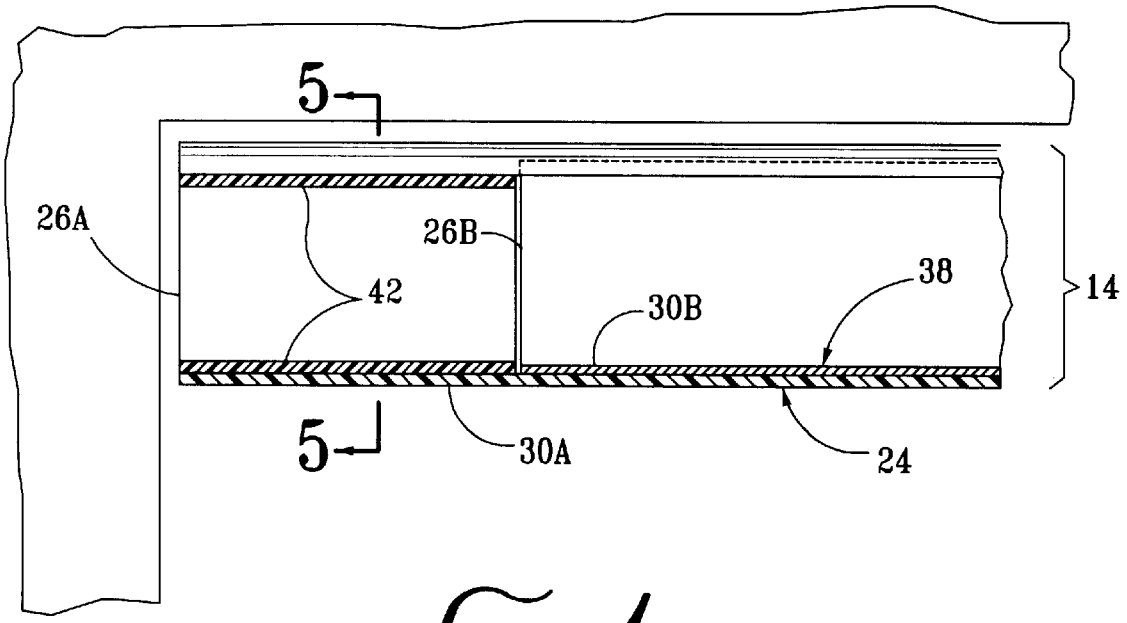
FIG. 4

VENETIAN BLINDS

RELATED APPLICATION

The present Application is a continuation-in-part of Taiwan Patent Application No. 88221196, filed on Dec. 28, 1999, by Ming Nien entitled STRUCTURAL IMPROVEMENT ON VENETIAN BLINDS, the contents of which are incorporated herein by reference in its entirety.

FIELD OF THE INVENTION

This invention relates generally to venetian blinds, and more specifically to headers for venetian blinds.

BACKGROUND OF THE INVENTION

Venetian blinds are age-old fixtures that are attached to a door or window to provide privacy, shade, and decoration. The overall width of venetian blinds is typically roughly equivalent to the width of the window or doorframe to which they are mounted. Unfortunately, doors and windows come in a wide variety of widths. Since the cost associated with manufacturing blinds in every conceivable door and window width is exorbitant, the blinds must be custom trimmed in most cases.

Venetian blinds which are manufactured to accommodate wide widows or doors typically incorporate a metal plate in the header to prevent the body of the header from sagging. A problem occurs when attempting to trim such a header because devices and methods which are effective for cutting the metal plate are not effective for cutting the body of the header. A die and punching tool works most effectively to produce a smooth surface upon trimming the metal plate, while conventional saw blades tend to produce an unfinished jagged edge in the metal. A disadvantage with using die and punching tools is that a separate die is needed for each differently sized header. This results in a much greater expense if headers having various cross-sectional heights and widths are going to be trimmed. Also, the dies must precisely fit the header in order to avoid an uneven finish or chipping of the header. Additionally, dies can bend and crimp parts of the header made of plastic or other less rigid materials.

Another problem encountered when cutting headers is that the header is often broken or damaged during the cutting process. This occurs because the header of prior art blinds are typically U-shaped and the two side panels are not provided with adequate lateral support to withstand forces associated with cutting.

Accordingly, there is a need for venetian blinds which incorporate a support as part of the header to allow the blinds to span relatively wide window or door frames without sagging, but which can be effectively and efficiently reduced by cutting with a blade. There is also a need for venetian blinds that have a header that is better suited to being cut without incurring damage.

SUMMARY

The invention is directed to venetian blinds the satisfy this need. The venetian blinds have a headrail and a slat-structure depending downwardly therefrom. The headrail includes an elongate cover made from a first material. The elongate cover has a longitudinal axis and a pair of opposed ends. The headrail also includes an elongate support member having a longitudinal axis and a pair of opposed ends. The elongate support member is made from a second material and is attached coaxially to the elongate cover so as to provide the elongate cover with increased rigidity. The length of the elongate support member along its longitudinal axis is less than the length of the elongate cover along its longitudinal axis so that the opposed ends of the elongate cover extend distally beyond the opposed ends of the elongate support member, whereby the length of the outer cover material can be reduced by cutting off a portion of at least one of its two ends normal to its longitudinal axis without cutting the elongate support member.

In another aspect of the invention, the venetian blinds include a headrail with an elongate cover having opposed ends, wherein the headrail has side wall stiffeners that provide increased structural integrity to the side walls when the opposed ends of the outer cover are subjected to cutting.

DRAWINGS

These features, aspects and advantages of the present invention will become better understood with regard to the following description, appended claims and accompanying FIGS. where:

FIG. 3 is a perspective view of venetian blinds having features of the invention;

Figure 5A:
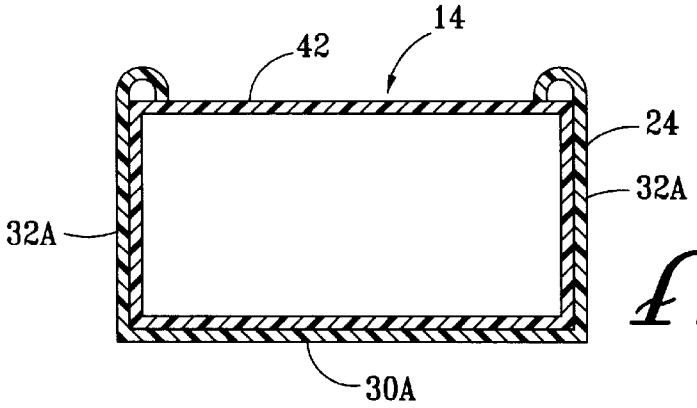
Figure 5B:
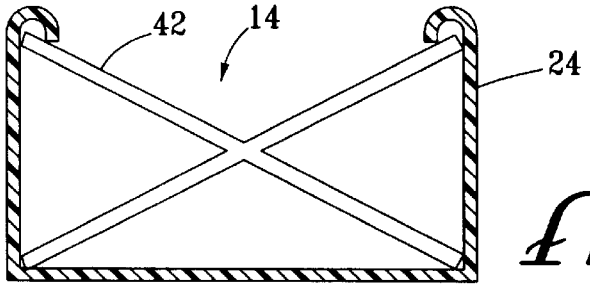
Figure 6:
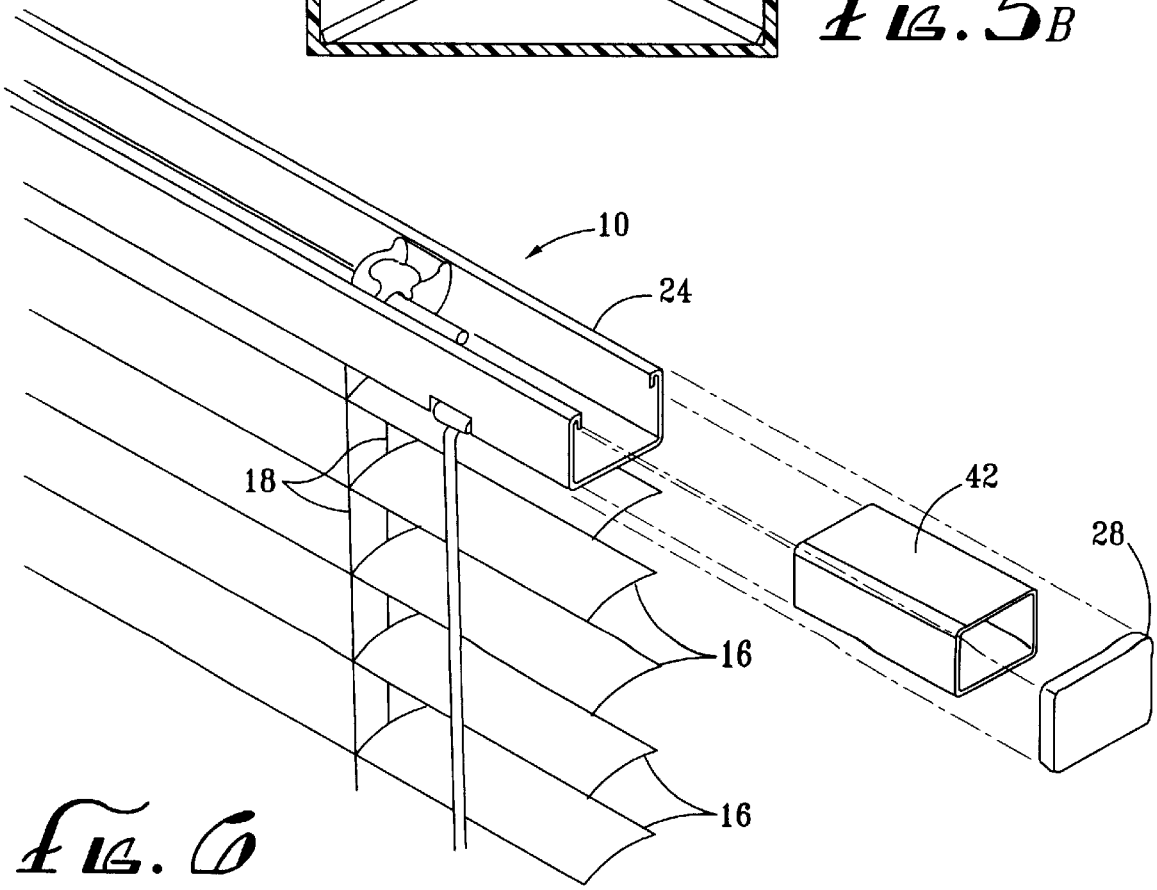

FIG. 4 a cross-sectional view of the venetian blinds of FIG. 3, taken along line 4—4;

FIG. 5A is a cross-sectional view of the venetian blinds of FIG. 4, taken along line 5—5;

FIG. 5B is a crosssectional view of a fourth alternative set of venetian blinds having features of the invention; and FIG. 6 is a perspective view of a fifth alternative set of venetian blinds having features of the invention.

DETAILED DESCRIPTION

The following discussion describes in detail two embodiments of the invention and several variations of those embodiments. This discussion should not be construed, however, as limiting the invention to those particular embodiments. Practitioners skilled in the art will recognize numerous other embodiments as well.

The invention is directed to venetian blinds 10 and methods of cutting the venetian blinds 10. With reference to the embodiment illustrated in FIG. 1, the venetian blinds 10 generally comprise a slat-structure 12 depending downwardly from a headrail 14.

The slat-structure 12 of the venetian blinds 10 comprises a plurality of horizontal spaced apart slats 16 that are supported by flexible cord members 18. There are typically two flexible cord members 18 that function to support, lift, and tilt the slats 16. The flexible cord members 18 typically cooperate with conventional lift and tilt mechanisms that attach to the headrail 14 of the venetian blinds 10.

The headrail 14 is mounted to a support structure, such as a window frame. The headrail 14 has an open mounting surface 20 that is typically oriented towards the support structure. The headrail 14 contains mounting members 22 or cooperates with mounting members 22 that attach to the support structure.

Typically, the overall length of the headrail 14 is at least 3 feet. Preferably, the overall length of the headrail 14 is between about 4 feet and about 8 feet. Further preferable, the overall length of the headrail 14 is between about 4 feet and about 6 feet.

The headrail 14 comprises a elongate cover 24 made from a first material. The elongate cover 24 has a longitudinal axis and a pair of opposed ends 26A. Typically, the opposed ends 26A of the elongate cover 24 have end caps 28 attached at the termini of the elongate cover 24. Referring to the alternative embodiments illustrated in FIG. 2, the elongate cover 24 typically has a generally planar bottom wall 30A and two generally planar opposing side walls 32A. The planar side walls 32A have a free edge 34 and a bottom edge 36. The bottom edge 36 of each generally planar side wall 32A is adjoined to the bottom wall 30A at an angle of about 90 degrees. The bottom wall 30A and two side walls 32A cooperate to define an elongate cover 24 configured as a substantially U-shaped trough that defines a generally open mounting surface 20.

In an embodiment of the invention, the headrail 14 further comprises an elongate support member 38 attached coaxially to the elongate cover 24 to provide the elongate cover 24 with increased rigidity. The elongate support member 38 is made from a second material. The elongate support member 38 has a longitudinal axis and a pair of opposed ends 26B.

Figure 2A:
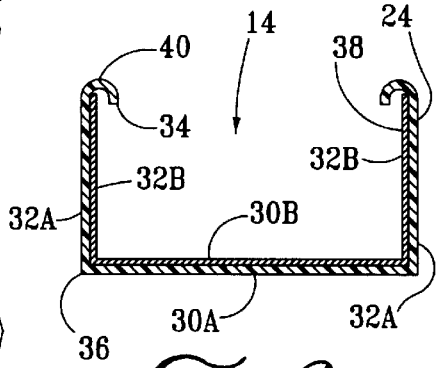
FIG. 2A is a cross-sectional view of the venetian blinds of FIG. 1 taken along line 2—2.
Figure 2B:
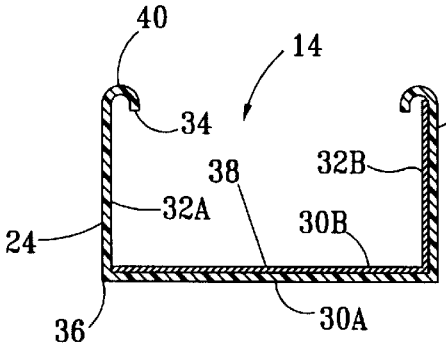
FIG. 2B is crosssectional view of a first alternative set of venetian blinds having features of the invention.

In preferred embodiments, at least a portion of the elongate support member 38 has a shape that is complementary to the elongate cover 24. Typically, the elongate support member 38 is sized and dimensioned to be complementary with the elongate cover 24 so that the elongate cover 24 wraps around the elongate support member 38. As illustrated in FIGS. 2A and 2B, each generally planar side wall 32A of the elongate cover 24 terminates in an inwardly curved rim 40 at its free edge 34. The inwardly curved rim 40 straddles the elongate support member 38 and attaches the elongate support member 38 coaxially to the elongate cover 24. Preferably, the elongate support member 38 slidably interconnects with the elongate cover 24 and reversibly attaches the elongate support member 38 coaxially to the elongate cover 24.

In the embodiment illustrated in FIG. 2A, the elongate support member 38 has a generally planar bottom wall 30B and two generally planar opposing side walls 32B. In this embodiment, the elongate support member 38 is substantially U-shaped in cross-section and the two side walls 32A of the elongate cover 24 wrap around the elongate support member 38 and the two inwardly curved rims 40 straddle the side walls 32B of the elongate support member 38 and attaches the elongate support member 38 coaxially to the elongate cover 24.

In the embodiment illustrated in FIG. 26, the elongate support member 38 has a generally planar bottom wall 30B and one generally planar side wall 32B such that the elongate support member 38 is substantially L-shaped in cross-section. The elongate support member 38 is sized and dimensioned to fit inside the elongate cover 24 and is shaped in accordance with the bottom wall 30A and one side wall 32A of the elongate cover. In this embodiment, one side wall 32A of the elongate cover 24 wraps around the elongate support member 38 and one inwardly curved rim 40 straddles one side wall 32B of the elongate support member 38 and attach the elongate support member 38 coaxially to the elongate cover 24.

Figure 2C:
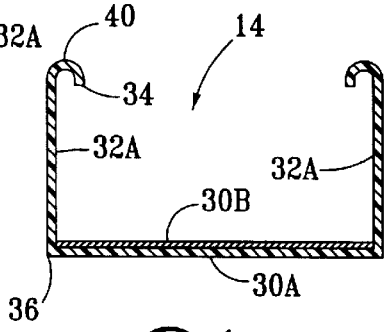
FIG. 2C is a cross-sectional view of a second alternative set of venetian blinds having features of the invention.

In the embodiment illustrated in FIG. 2C, the elongate support member 38 is substantially planar and is attached coaxially to the bottom wall 30A of the elongate cover 24.

Figure 2D:
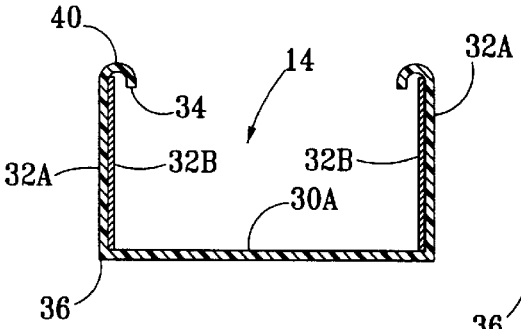
FIG. 2D is a cross-sectional view of a third alternative set of venetian blinds having features of the invention.

In the embodiment illustrated in FIG. 2D, the elongate support member 38 comprises two substantially planar side walls 328 that are disposed adjacent to the side walls 32A of the elongate cover 24.

Figure 2E:
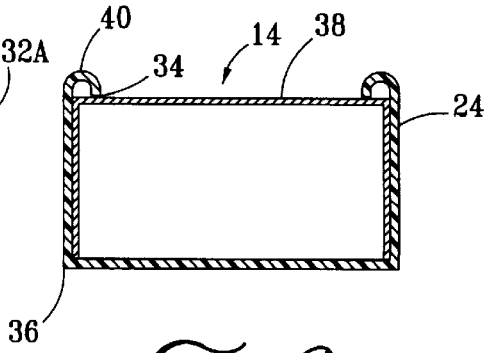
FIG. 2E is a cross-sectional view of a fourth alternative set of venetian blinds having features of the invention.

In the embodiment illustrated in FIG. 2E, the elongate support member 38 comprises a generally U-shaped member that, when inverted, fits within the U-shaped trough of the elongate cover 24.

Figure 1:
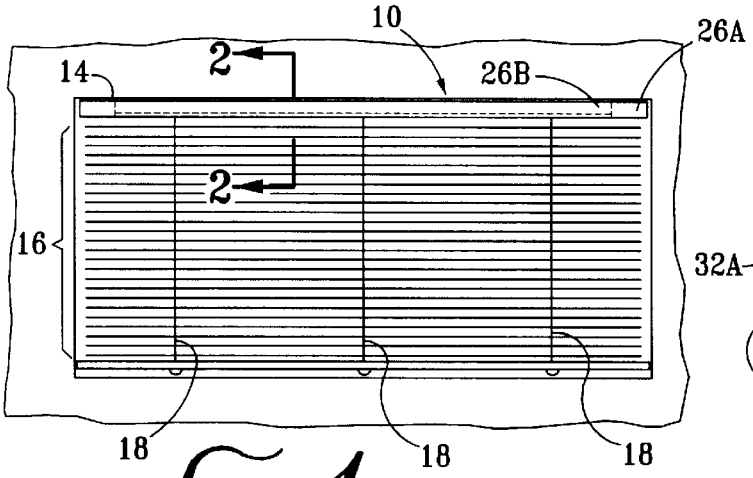
FIG. 1 is front view of venetian blinds having features of the invention.

Referring to the embodiment illustrated in FIG. 1, the length of the elongate support member 38 along its longitudinal axis is less than the length of the elongate cover 24 along its longitudinal axis so that the opposed ends 26A of the elongate cover 24 extend distally beyond the opposed ends 26B of the elongate support member 38. In this embodiment, the length of the first material of the elongate cover 24 can be reduced by cutting off a portion of at least one of its two opposed ends 26A normal to its longitudinal axis without cutting the elongate support member 38. Preferably, the elongate cover 24 is at least about 2 inches longer than the elongate support member 38. Further preferable, the elongate cover 24 is at least about 4 inches longer than the elongate support member 38. Still further preferable, the elongate cover 24 is between about 4 inches and about 10 inches longer than the elongate support member 38 and each opposed end 26A of the elongate cover 24 extends beyond an opposed end 26B of the elongate support member 38 by between about 2 inches and about 5 inches.

The second material of the elongate support member 38 is generally more rigid than the first material of the elongate cover 24. Preferably, the first material is selected from the group consisting of plastics, fabrics, wood, metals, and composites. Preferably, the second material comprises a metal, such as aluminum or steel, because metals provide a high degree of rigidity and are relatively inexpensive. In a preferred embodiment, the first material is a plastic and the second material is sheet metal. Typically, the thickness of the first material is between about 0.1 mm and about 5 mm. More typically, the thickness of the first material is between about 0.5 mm and about 3 mm. Typically, the thickness of the second material is between about 0.1 mm and about 1 mm. The elongate cover 24 is typically colored, such as by dye or paint, so as to be aesthetically pleasing.

In another embodiment of the invention, the headrail 14 comprises side wall stiffeners 42 in abutment with the side walls 32A of the elongate cover 24. The side wall stiffeners 42 may be affixed to the side walls 32A or detached from the side walls 32A of the elongate cover 24. Preferably, there is one side wall stiffener 42 disposed proximal to each opposed end 26A of the elongate cover 24. The side wall stiffeners 42 provide lateral support and increased structural integrity to the two generally planar side walls 32A of the elongate cover 24 so as to inhibit lateral movement and vibration of the side walls 32A of the elongate cover 24 in at least one direction. This support reduces the incidence of damage to the side walls 32A when the opposed ends 26A of the elongate cover 24 are subjected to cutting. In the embodiment illustrated in FIG. 4, the side wall stiffeners 42 are utilized in venetian blinds 10 in which the headrail 14 comprises an elongate support member 38. In this embodiment, the side wall stiffeners 42 are preferably disposed at the opposed ends 26A of the elongate cover 24 such that the side wall stiffeners 42 do not overlap with the elongate support member 38 along the longitudinal axis of the In the embodiment illustrated in FIG. 6, the side wall stiffeners 42 are utilized in venetian blinds 10 in which the headrail 14 does not comprise an elongate support member 38.

In the embodiment illustrated in FIGS. 5A and 6, the side wall stiffeners 42 are hollow and substantially rectangular in cross-section so as to define a shape of that of a rectangular parallelepiped. The side wall stiffeners 42 are disposed within the U-shaped trough defined by the elongate cover 24 and one side wall stiffener 42 is located proximal to each opposed end 26A of the elongate cover 24. In these embodiments, the length of each side wall stiffener 42 along the axis parallel to the longitudinal axis of the elongate cover 24 is typically between about 2 inches and about 5 inches. However, the side wall stiffeners 42 may be shorter or longer in other embodiments.

The shape and configuration of the side wall stiffeners 42 is not limited to any particular design. The side wall stiffeners 42 can be sized, shaped, and configured differently as long as they inhibit lateral movement and vibration of the side walls 32A in at least one direction. For example in alternative embodiments (not shown), the side wall stiffeners 42 are substantially solid and made from a material such as, for example, a stiff foam, plastic, or wood. In the embodiment illustrated in FIG. 5B, each side wall stiffener 42 is substantially X-shaped in cross-section and elongate. In an alternative embodiment (not shown), each side wall stiffener 42 comprises a generally planar top wall attached to at least a portion of the free edge 34 of each opposed side wall 32A of the elongate cover 24. In this embodiment, at least a portion of the opposed ends 26A of the elongate cover 24 are generally rectangular in cross-section. In other embodiments, the side wall stiffeners 42 are not elongate with respect to the longitudinal axis of the elongate cover 24. For example, each side wall stiffener 42 may comprise a rod, bar, arm or similar such article that transverses the U-shaped trough and is in abutment with each opposing side wall 32A. Alternatively, each side wall stiffener 42 may comprise a generally U-shaped member that, when inverted, fits within the U-shaped trough so as to provide two linear segments in abutment with the side walls 32A and one substantially linear segment that transverses between the side walls 32A.

In order to cut the Venetian blinds 10 described herein, the venetian blinds 10 described above are selected and retained in a relatively immobile cutting position. If an embodiment with an elongate support member 38 is selected, the headrail 14 is cut such that the length of the first material of the elongate cover 24 is reduced without cutting the elongate support member 38. The slat-structure 12 is cut to about the same length as the headrail 14 so that the overall width of the Venetian blinds 10, as defined by the length of the headrail 14 and the length of the slat-structure 12, is substantially equivalent. The slat-structure 12 may be cut substantially simultaneously with the headrail 14 or independently of the headrail 14.

When an embodiment having side wall stiffeners 42 is selected, a person cuts at least a portion of the headrail 14 proximal to the side wall stiffeners 42 such that the headrail 14 is substantially free from breaking or chipping upon being cut and also cuts the slat-structure 12 so that the slats 16 are about the same length as the headrail 14. This method may be used in embodiments having an elongate support member 38 or in embodiments not having an elongate support member 38.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A venetian blind comprising a headrail and a slat-structure depending downwardly therefrom, the slat-structure comprising a plurality of spaced apart slats supported by flexible cord members, the headrail comprising:

a) an elongate cover having a longitudinal axis and a pair of opposed ends, the elongate cover being made from a first material; and b) an elongate support member having a longitudinal axis and a pair of opposed ends, the elongate support member being made from a second material, the elongate support member being attached coaxially to the elongate cover so as to provide the elongate cover with increased rigidity;

wherein the length of the elongate support member along its longitudinal axis is less than the length of the elongate cover along its longitudinal axis;

whereby the length of the outer cover material can be reduced by cutting off a portion of at least one of its two ends normal to its longitudinal axis without cutting the elongate support member.

2. The venetian blind of claim 1 wherein the second material is more rigid than the first material.

3. The venetian blind of claim 1 wherein the elongate cover is substantially U-shaped.

4. The venetian blind of claim 3 wherein each generally planar side wall terminates in an inwardly curved rim at the free edge of the generally planar side walls.

5. The venetian blind of claim 3 wherein the elongate support member comprises one piece of metal having a generally planar bottom wall and two generally planar opposing side walls in connection with the bottom wall.

6. The venetian blind of claim 3 wherein the elongate support member comprises one piece of metal having a generally planar bottom wall and one generally planar side wall in connection with the bottom wall.

7. The venetian blind of claim 1 wherein the first material is selected from the group consisting of plastics, fabrics, wood, metals, and composites.

8. The venetian blind of claim 1 wherein the second material is metal.

9. The venetian blind of claim 1 wherein the elongate support member slidably interconnects with the elongate cover and reversibly attaches the elongate support member coaxially to the elongate cover.

10. The venetian blind of claim 1 wherein the elongate cover is at least about 2 inches longer than the elongate support member.

11. The venetian blind of claim 1 wherein the elongate cover is at least about 4 inches longer than the elongate support member.

12. The venetian blind of claim 1 wherein the elongate cover is between about 4 inches and about 10 inches longer than the elongate support member and each opposed end of the elongate cover extends beyond an opposed end of the elongate support member by between about 2 inches and about 5 inches.

13. The Venetian blind of claim 1 wherein the overall length of the headrail is at least 3 feet.

14. The venetian blind of claim 1 wherein the overall length of the headrail is between about 4 feet and about 8 feet.

15. The venetian blind of claim 1 wherein the overall length of the headrail is between about 4 feet and about 6 feet.

16. The venetian blind of claim 1 wherein the elongate cover is substantially U-shaped, the headrail further comprising side wall stiffeners in abutment with the side walls, the side wall stiffeners being disposed proximal to the opposed ends of the outer cover, whereby the side wall stiffeners inhibit lateral movement and vibration of the side walls in at least one direction so as to reduce the incidence of damage to the side walls when the ends of the outer cover are subjected to cutting.

17. A venetian blind comprising a headrail and a slat-structure depending downwardly therefrom, the slat-structure comprising a plurality of horizontal spaced apart slats supported by flexible cord members, the headrail comprising:

a) an elongate cover having a longitudinal axis and a pair of opposed ends, the elongate cover being made from a first material, at least a portion of the elongate cover comprising a generally planar bottom wall and two generally planar opposing side walls adjoined to the generally planar bottom wall at an angle of about 90 degrees, whereby the bottom wall and two side walls cooperating to define an generally open mounting surface; and b) an elongate support member having a longitudinal axis and a pair of opposed ends, the elongate support member being made from a second material more rigid than the first material, the elongate support member being attached coaxially to the elongate cover so as to provide the elongate cover with increased rigidity;

wherein the elongate cover is between about 4 inches and about 10 inches longer than the elongate support member and each opposed end of the elongate cover extends beyond an opposed end of the elongate support member by between about 2 inches and about 5 inches;

whereby the length of the outer cover material can be reduced by cutting off a portion of at least one of its two ends normal to its longitudinal axis without cutting the elongate support member.

18. A method of cutting venetian blinds comprising the steps of:

a) selecting the venetian blinds of claim 1;

b) retaining the venetian blinds in a relatively immobile cutting position;

c) cutting the headrail such that the length of the outer cover material is reduced by cutting without cutting the elongate support member; and d) cutting the slat-structure so that the slats are about the same length as the headrail.

19. A venetian blind comprising a headrail and a slat-structure depending downwardly therefrom, the slat-structure comprising a plurality of horizontal spaced apart slats supported by flexible cord members, the headrail comprising a generally U-shaped elongate cover having a longitudinal axis and a pair of opposed ends whereby the length of the outer cover material can be reduced by cutting off a portion of at least one of its two ends normal to its longitudinal axis, the headrail further comprising side wall stiffeners in abutment with the side walls, the side wall stiffeners being disposed proximal to the opposed ends of the outer cover, the side wall stiffeners being hollow and substantially rectangular in cross-section so as to define a shape of that of a rectangular parallelepiped, whereby the side wall stiffeners inhibit lateral movement and vibration of the side walls in at least one direction so as to reduce the incidence of damage to the side walls when the ends of the outer cover are subjected to cutting.

20. A method of cutting venetian blinds comprising the steps of:

a) selecting the Venetian blinds of claim 19;

b) retaining the venetian blinds in a relatively immobile cutting position;

c) cutting at least a portion of the headrail proximal to the side wall stiffeners such that the headrail is substantially free from breaking upon being cut; and d) cutting the slat-structure so that the slats are about the same length as the headrail.

21. A venetian blind comprising a headrail and a slat-structure depending downwardly therefrom, the slat-structure comprising a plurality of spaced apart slats, the headrail comprising a generally U-shaped elongate cover having a longitudinal axis and a pair of opposed ends whereby the length of the outer cover material can be reduced by cutting off a portion of at least one of its two ends normal to its longitudinal axis, the headrail further comprising side wall stiffeners in abutment with the side walls, the side wall stiffeners being made from a non-metal material, the side wall stiffeners being disposed proximal to the opposed ends of the outer cover, whereby the side wall stiffeners inhibit lateral movement and vibration of the side walls in at least one direction so as to reduce the incidence of damage to the side walls when the ends of the outer cover are subjected to cutting.

22. The venetian blind of claim 21, wherein the non-metal material is cuttable.

23. The venetian blind of claim 21, wherein the non-metal material is selected from the group consisting of plastic, wood, and foam.

24. A venetian blind comprising a headrail and a slat-structure depending downwardly therefrom, the slat-structure comprising a plurality of spaced apart slats, the headrail comprising a generally U-shaped elongate cover having a longitudinal axis and a pair of opposed ends whereby the length of the outer cover material can be reduced by cutting off a portion of at least one of its two ends normal to its longitudinal axis, the headrail further comprising side wall stiffeners in abutment with the side walls, the side wall stiffeners being disposed proximal to the opposed ends of the outer cover with the length of each side wall stiffener along its axis parallel to the longitudinal axis of the elongate cover being between about 2 inches and about 5 inches, whereby the side wall stiffeners inhibit lateral movement and vibration of the side walls in at least one direction so as to reduce the incidence of damage to the side walls when the ends of the outer cover are subjected to cutting.

* * * * *